United States Patent [19]

Bedocs

[11] 4,188,136

[45] Feb. 12, 1980

[54] KEYBOARD SWITCH ACTUATOR AND LOCKING ASSEMBLY

[75] Inventor: Michael F. Bedocs, Waukegan, Ill.

[73] Assignee: Cherry Electrical Prod's. Corp., Waukegan, Ill.

[21] Appl. No.: 870,672

[22] Filed: Jan. 19, 1978

[51] Int. Cl.[2] ..... B41J 5/22; H01H 9/26; H01H 3/20

[52] U.S. Cl. ..... 400/276; 400/479; 400/496; 400/678; 200/50 C; 200/5 B

[58] Field of Search ..... 400/276, 276.2, 678, 400/479, 496; 200/50 C, 5 B

[56] References Cited

U.S. PATENT DOCUMENTS

| | | | |
|---|---|---|---|
| 2,622,160 | 12/1952 | Werner | 200/5 E |
| 3,392,592 | 7/1968 | Waldorf et al. | 200/5 E |
| 3,626,120 | 12/1971 | Wright | 200/5 E |
| 3,711,685 | 1/1973 | Castle | 400/479 |
| 3,863,748 | 2/1975 | Trezise | 400/276 |
| 3,882,295 | 5/1975 | Madland | 400/479 |
| 4,010,838 | 3/1977 | Sims, Jr. | 400/496 |
| 4,071,719 | 1/1978 | Madland | 400/479 |

FOREIGN PATENT DOCUMENTS 304088 2/1918 Fed. Rep. of Germany ..... 400/276

OTHER PUBLICATIONS

Harris, Electronic Keyboard Shiftlock Mechanism, IBM Technical Disclosure Bulletin, vol. 20, No. 10, p. 4037, 3/78.

Crome, Electronic Keyboard Shiftlock Mechanism, IBM Technical Disclosure Bulletin, vol. 20, No. 1, p. 258, 6/77.

*Primary Examiner*—William Pieprz

[57] ABSTRACT

A switch actuator and position-locking means for module keyboard assemblies such as are used in data-processing machines and the like, utilizing key operable electric switches. The switch actuator is of the type normally associated with what is commonly called a "shift key" or "spacer bar," wherein the finger-engaging portion of the actuator is of a size greater than a single switch module, with the switch adapted to be mechanically locked in operative position and released by successive actuation of a related switch module.

3 Claims, 14 Drawing Figures

KEYBOARD SWITCH ACTUATOR AND LOCKING ASSEMBLY

SUMMARY OF THE INVENTION

Keyboard assemblies have in the past included arrangements for stabilizing and equalizing distribution of an actuating force component onto an elongated switch actuator button, as well as for releasably latching an actuated key switch in its depressed position pending a subsequent actuation by a related key switch. One of the frequently missing features in prior keyboard assemblies was the ability for the operator to release the depressed locked key from either the right or the left-hand side of the keyboard. This invention accomplishes this at a reasonable cost and with a small amount of tooling.

Keyboard assemblies provide an elongated or oversize key button, such as a shift key or a spacer bar key, which require operation thereof through a substantially vertical force component applied at any point thereon throughout the length of such key. This key is normally supported upon the plunger of a switch related thereto, which is positioned beneath the key-actuating button, and it may at times include either a single or a dual guided plunger joined together by an elongated torsion rod, which assures and achieves universal action.

The locking structure for a key which functions to retain the selected key in a depressed condition, comprises a latch cam carried by the lockable switch and a release cam carried by an associated switch structure or by the guide module heretofore referred to.

GENERAL DESCRIPTION

The objects of this invention are achieved through the structure shown in the accompanying drawings, which illustrate a preferred form of construction, and in which.

Figure 1:
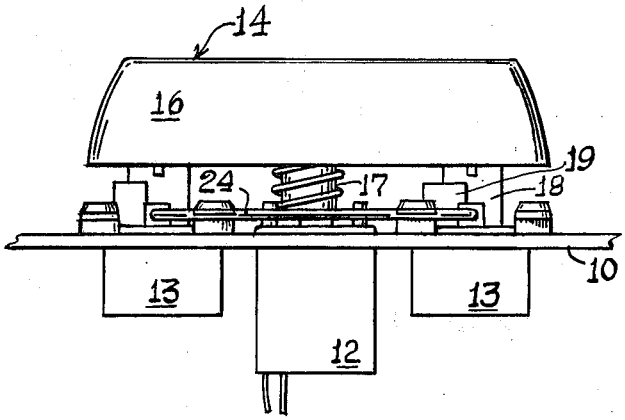
FIG. 1 is a front elevational view of a switch module and its over-sized actuating button.
Figure 6:
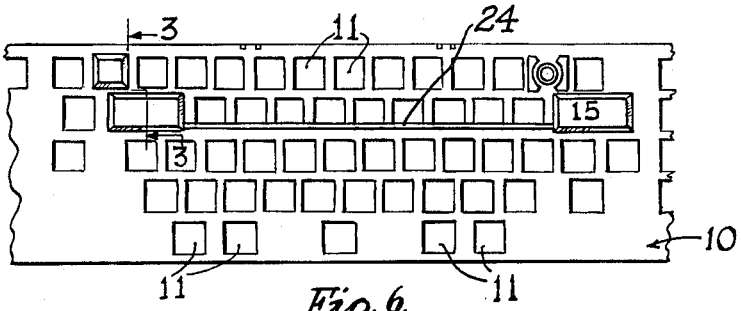
FIG. 6 is a fragmentary top plan view of a keyboard assembly.

The invention described hereinafter is utilized in a keyboard 10, such as is shown in FIG. 6, wherein there is arranged a matrix of openings 11 adapted to frictionally receive either a switch module 12 or a guide module 13, such as shown in FIG. 1.

Figure 2:
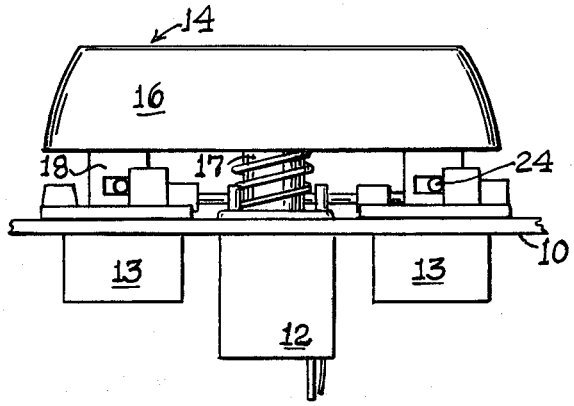
FIG. 2 is a rear elevational view similar to FIG. 1.
Figure 3:
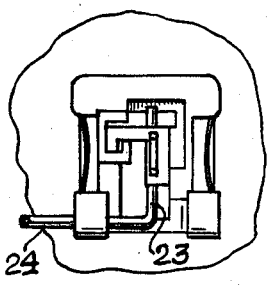
FIG. 3 is a partial top plan view of the stabilizing guide module as shown in FIGS. 1 and 2.
Figure 7:
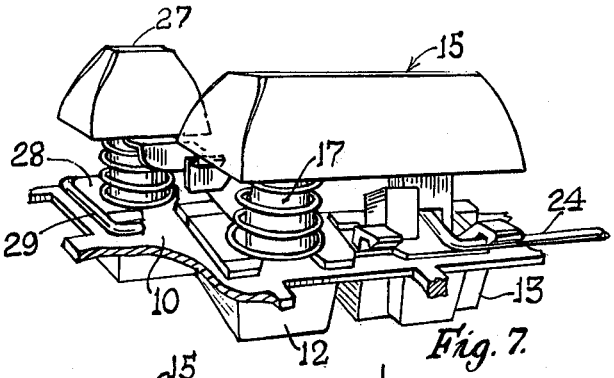
FIG. 7 is a fragmentary perspective view of the guide module and lock-in switch modules.

The switch actuator of this invention is shown as at 14 in FIGS. 1 and 2 and as at 15 in FIGS. 6 and 7. As such, these switch actuators 14 and 15 comprise an elongated hollow button 16, which may be of any length required for a preselected function, such as a spacer bar or a shift key. The button 16 is attached to a plunger 17 extending vertically from the switch module 12, such as shown in FIG. 1.

Figure 4:
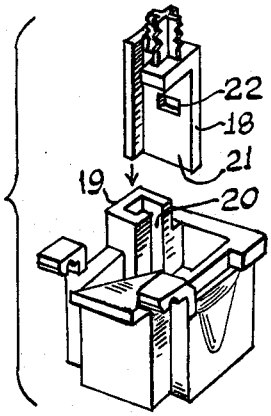
FIG. 4 is a perspective view of the components of the guide module in an exploded relation.
Figure 5:
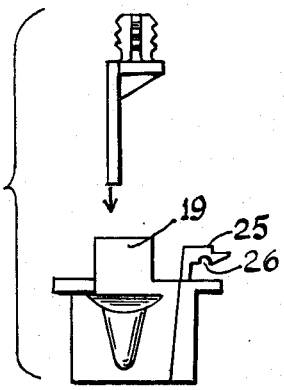
FIG. 5 is a side elevational view of the guide module.

The button 16 may also be attached to a guide plunger 18 (there being two shown in FIGS. 1 and 2), which is slidably contained in a guide housing 19 vertically extending from the guide module 13, as shown. In referring to FIGS. 4 and 5, it is noted that the guide housing 19 provides a generally L-shaped passage 20 which extends throughout the vertical length of the housing 19, which in turn is adapted to receive the guide plunger 18 which is likewise L-shaped.

By this construction, the vertical movement of the guide plunger 18 through the guide housing 19 is maintained through a vertical component by the tolerances formed between the L-shaped passage 20 and the L-shaped plunger 18. It should be noted that in the leg 21 of the guide plunger 18 there is an opening 22 through which one end 23 of an elongated torsion rod 24 projects. The guide module 13 also provides adjacent the corresponding corners thereof wings 25 which have their under surface partially arcuated as at 26 and which freely receive therein the torsion rod 24.

As shown in FIGS. 1 and 2, the switch actuator 24 is of a length to extend over a single switch module 12 and two corresponding guide modules 13. By this arrangement, when the actuator 16 is depressed by the fingers of an operator so as to actuate the switch 12, the force component upon the button 16 may be at any point throughout its longitudinal length, and it will be transmitted through the torsion rod 24 to either guide module 13, thus effecting equalization of the force upon the switch plunger 17 so as to actuate the switch module 12.

In the event that the keyboard is to be arranged as shown in FIG. 6, where it is shown that the actuators 15 are disposed adjacent the opposite edges of the keyboard 10, the only part affected is the torsion rod 24, in that, as shown in FIG. 6, it must be of a length so as to extend between the displaced switch actuators 15.

It should be noted that the keyboard 10 has a matrix of openings 11 all of uniform size such that they will readily receive and hold therein either a full switch module 12 or a guide module 13 as heretofore described. Thus, changing the arrangement of the keyboard 10 is of no consequence except for the torsion rod 24 hereinbefore identified.

A feature of the invention is to permit a locking in of an actuated switch module and the release thereof through the actuator of either of the switch actuators 15, as shown in FIG. 6. To accomplish this object, the selected key to be locked in, such as 27, in FIGS. 7 through 10, is associated with a switch module 28 which has snapped about the periphery thereof a latch spring 29.

Figure 12:
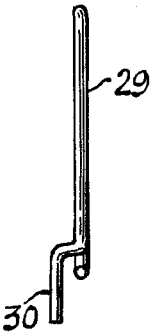
FIG. 12 is a side view of the latch spring.
Figure 13:
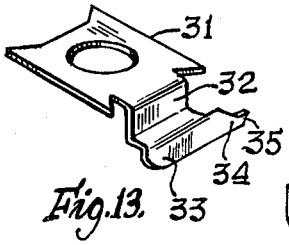
FIG. 13 is a perspective view of the latch cam.
Figure 14:
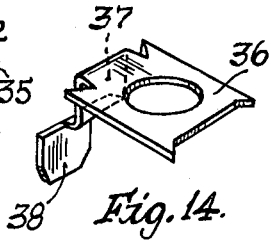
FIG. 14 is a perspective view of the release cam.

As shown in FIG. 12, the latch spring 29 has one end angled so as to present a short latch leg 30 adapted to be disposed in an elevated plane with respect to the surface of the keyboard 10. This is clearly shown in FIGS. 8 through 10. The plunger of the switch 27 has mounted thereon a latch plate 31, which at one edge provides a depending flange 32 which terminates into an inverted L-shaped latch cam 33. One end of the latch cam 33 extends beyond one edge of the depending flange 32 and provides a latch finger 34 which is provided with one inclined edge surface 35, the purpose and function of which will be hereinafter made apparent.

Figure 8:
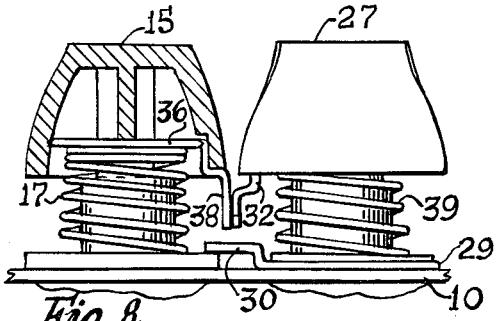
FIG. 8 is a side elevational view of the lock-in switch modules in normal position.
Figure 9:
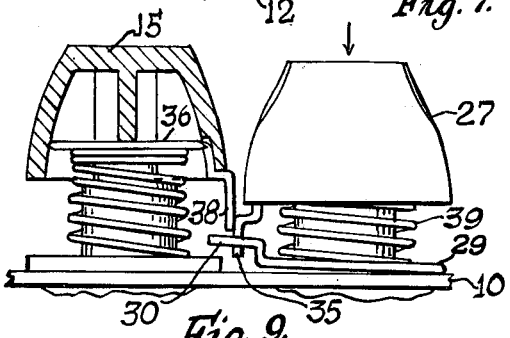
FIG. 9 is a side elevational view similar to FIG. 8, with one switch module in locked-in position.
Figure 10:
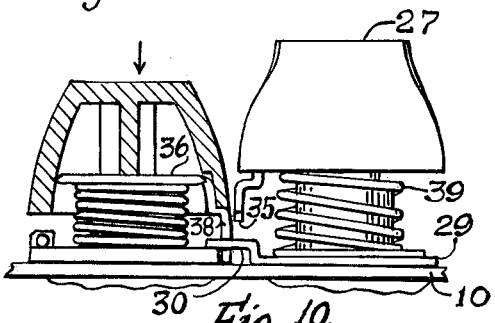
FIG. 10 is a side elevational view similar to FIG. 8 showing the parts in a releasing position.
Figure 11:
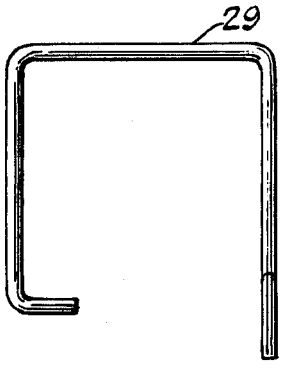
FIG. 11 is a plan view of the latch spring as used in this invention.

In the construction shown in FIGS. 7 through 10, the switch module 12 provides a plunger 17 which has attached to it a releasing plate 36 providing at one end a depending flange 37, which terminates into a release cam 38. The latch plate 31 and releasing plate 36 are adapted to be disposed in confronting relation as shown in FIGS. 8 through 10.

In operation, when the actuator 27 of the switch module 28 is depressed, it, together with the latch plate 31, will move in the direction of the keyboard 10, with the inclined edge 35 of the latch finger 34 engaging the latch leg 30 so as to cam the same around the latch finger 34 to hold the actuator 27 in its depressed condition and the switch module 28 actuated as shown in FIG. 9.

To release the locked-in switch, either actuator 15, as shown in FIG. 6, may be depressed and by reason of the stabilizing arrangement including the torsion rod 24, the actuator 15 adjacent the depressed locked-in actuator 27 will likewise be depressed. With the depression of the actuator 15, the releasing plate 36 will also move in a downward direction until its release cam 38 engages the latch leg 30 and moves it against its bias out of latching contact with the latch cam finger 34 of the latch plate 31 of the switch button 27, permitting the same to return under tension of its spring 39, to its original position.

From the foregoing, I have described a key actuator and locking mechanism which, except for one component, is of a modular construction, so that various arrangements and positioning of the assembly may be achieved. I have provided a positive stabilizing and equalizing actuating force which may be transmitted between spaced switch modules through a connecting torsion rod as well as a single switch lock-in and lock-release structure, which may be operated from a multitude of positions of interconnected switch modules positioned in a keyboard matrix.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A key actuator and locking mechanism for use with a keyboard having a matrix of key-receiving openings for positioning a plurality of key housings thereon wherein the improvement comprises (a) a first and second manually operated switch key, each including a key stem projecting out of an identical switch housing which are adapted to be selectively mounted within the key-receiving openings formed in the keyboard, (b) a latch plate mounted on and movable with the stem of said first switch key and providing a latching cam extending transversely of and in spaced relation to said stem of said first key switch, (c) a latch spring consisting of a single spring wire adapted to embrace the housing of said first switch key and providing a deflectable raised biased latch leg positioned in the path of movement of said latching cam when said first switch key is depressed and cooperating therewith to releaseably hold said first switch key in a depressed position, and (d) a latch releasing cam carried by the stem of said second switch key and engageable with said deflectable latch leg when said second switch key is depressed so as to deflect said latch leg against its bias out of engagement with said latching cam to release said first switch key from its depressed position.

2. A key actuator and locking mechanism as defined by claim 1 including means connected to said second switch key and a remotely positioned switch key for effecting depression of said second switch key by said remotely positioned switch key whereby said latch releasing cam carried by said second switch key may be moved to disengage said latching cam from said latch leg.

3. A key actuator and locking mechanism as defined by claim 2 wherein said means connected between said second switch key and a remotely positioned switch key comprises an elongated torsion rod the ends of which are connected to means operatively connected with said second switch key and said remotely positioned key with said means being guided by guiding means in their movement through a vertical component whereby movement of either key is transmitted to the other for uniform movement therebetween.

* * * * *